US008401206B2

(12) United States Patent
Seltzer et al.

(10) Patent No.: US 8,401,206 B2
(45) Date of Patent: Mar. 19, 2013

(54) ADAPTIVE BEAMFORMER USING A LOG DOMAIN OPTIMIZATION CRITERION

(75) Inventors: Michael Lewis Seltzer, Seattle, WA (US); Ivan Jelev Tashev, Kirkland, WA (US)

(73) Assignee: Microsoft Corporation, Redmond, WA (US)

( * ) Notice: Subject to any disclaimer, the term of this patent is extended or adjusted under 35 U.S.C. 154(b) by 591 days.

(21) Appl. No.: 12/353,986

(22) Filed: Jan. 15, 2009

(65) Prior Publication Data

US 2010/0177908 A1 Jul. 15, 2010

(51) Int. Cl.
*H04R 3/00* (2006.01)

(52) U.S. Cl. ..... 381/92; 381/71.1; 381/94.2; 704/233

(58) Field of Classification Search ..... 381/92, 381/71.1, 71.11, 71.12, 94.2, 122, 94.1, 94.3, 381/71.6; 704/233, E15.039, 231; 379/406.08, 379/406.12

See application file for complete search history.

(56) References Cited

U.S. PATENT DOCUMENTS

| | | | | |
|---|---|---|---|---|
| 5,627,799 | A | 5/1997 | Hoshuyama | |
| 6,449,586 | B1 * | 9/2002 | Hoshuyama | 702/190 |
| 6,531,976 | B1 | 3/2003 | Yu | |
| 7,035,415 | B2 | 4/2006 | Belt et al. | |
| 7,359,504 | B1 | 4/2008 | Reuss et al. | |
| 2005/0147258 | A1 * | 7/2005 | Myllyla et al. | 381/71.11 |
| 2005/0195988 | A1 * | 9/2005 | Tashev et al. | 381/92 |
| 2006/0153360 | A1 | 7/2006 | Kellermann et al. | |
| 2006/0222184 | A1 | 10/2006 | Buck et al. | |
| 2007/0076898 | A1 * | 4/2007 | Sarroukh et al. | 381/92 |
| 2007/0088544 | A1 | 4/2007 | Acero et al. | |
| 2007/0230712 | A1 | 10/2007 | Belt et al. | |

FOREIGN PATENT DOCUMENTS

WO 2008061534 A1 5/2008

OTHER PUBLICATIONS

CSA-BF: A Constrained Switched Adaptive Beamformer for Speech Enhancement and Recognition in Real Car Environments, IEEE Transactions on Speech and Audio Processing, vol. 11, No. 6, Nov. 2003, p. 733-745.*

Mattias Dahl, "Acoustic Noise and Echo Cancelling—Microphone Array Methods and Applications", Department of Signal Processing, University of Karlskrona, May 1997, pp. 1-115.

Herbordt et al, "Hands-Free Speech Recognition and Communication on PDAS using Microphone Array Technology", IEEE Workshop on Automatic Speech Recognition and Understanding, 2005,Issue , Nov. 27-27, 2005 pp. 302-307.

(Continued)

*Primary Examiner* — Vivian Chin
*Assistant Examiner* — Leshui Zhang
(74) *Attorney, Agent, or Firm* — Gonzalez Saggio & Harlan LLP

(57) ABSTRACT

Described is a audio signal processing technology in which an adaptive beamformer processes input signals from microphones based on an estimate received from a pre-filter. The adaptive beamformer may compute its parameters (e.g., weights) for each frame based on the estimate, via a magnitude-domain objective function or log-magnitude-domain objective function. The pre-filter may include a time invariant beamformer and/or a non-linear spatial filter, and/or may include a spectral filter. The computed parameters may be adjusted based on a constraint, which may be selectively applied only at desired times.

20 Claims, 2 Drawing Sheets

OTHER PUBLICATIONS

Zhang et al,"CSA-BF: A Constrained Switched Adaptive Beamformer for Speech Enhancement and Recognition in Real Car Environments"IEEE Trans Speech & Audio Proc., vol. 11, No. 6, pp. 733-745, Nov. 2003.

Frost, O.L., III "An Algorithm for Linearly Constrained Adaptive Array Processing", Proceedings of the IEEE, vol. 60, Issue: 8, Aug. 1972, pp. 926-935.

Griffiths, et al, "An Alternative Approach to Linearly Constrained Adaptive Beamforming", IEEE Transactions on Antennas and Propagation vol. 30, Issue 1, Jan. 1982 pp. 27-34.

Tashev et al, "Microphone Array Post-Processor using Instantanous Direction of Arrival", Proceedings of International Workshop on Acoustic, Echo and Noise Control IWAENC 2006, pp. 1-4.

Kalluri, et al, "A General Class of Nonlinear Normalized Adaptive Filtering Algorithms", IEEE Transactions on Signal Processing vol. 47, Issue 8, Aug. 1999 pp. 1-6.

Sohn et al, "A Statistical Model-based Voice Activity Detection", IEEE Signal Processing Letters, vol. 6, Issue 1, Jan. 1999 pp. 1-3.

Rix, et al, "Perceptual Evaluation of Speech Quality (PES): An Objective Method for End-to-End Speech Quality Assessment of Narrow-Band Telephone Networks and Speech Codecs", Proceedings. (ICASSP apos;01). 2001 IEEE International Conference on Acoustics, Speech, and Signal Processing, 2001, vol. 2, Issue , 2001 pp. 749-752 vol. 2.

* cited by examiner

ADAPTIVE BEAMFORMER USING A LOG DOMAIN OPTIMIZATION CRITERION

BACKGROUND

Microphone arrays have long been used as a means of obtaining high quality sound capture. In general, the source signal is captured by multiple microphones and jointly processed to generate an enhanced output signal. For example, one or more microphones may be amplified while others are attenuated, resulting in a highly directional signal.

Current microphone array processing pipelines comprise two main stages, namely a linear beamformer that spatially filters the sound field, suppressing noise that comes from unwanted directions and a post-filter that performs additional noise reduction on the beamformer output signal. The output of the linear beamformer stage has some degree of noise reduction and generally improves perceptual quality. The output of the post-filter stage typically has much better noise reduction, but introduces artifacts into the output signal, which degrades the perceptual quality. As a result, in scenarios like videoconferencing and VoIP, the users/system designers are stuck with a choice of either minimal distortions but not much noise reduction or more noise reduction but significant distortions and artifacts.

SUMMARY

This Summary is provided to introduce a selection of representative concepts in a simplified form that are further described below in the Detailed Description. This Summary is not intended to identify key features or essential features of the claimed subject matter, nor is it intended to be used in any way that would limit the scope of the claimed subject matter.

Briefly, various aspects of the subject matter described herein are directed towards a technology by which an adaptive beamformer is used to process input signals from microphones based on an estimated signal received from a pre-filter. In one aspect, the adaptive beamformer computes its parameters (e.g., weights) based on the estimate via a log-magnitude-domain objective function.

In one aspect, the pre-filter may include a time invariant beamformer and/or a non-linear spatial filter. In an alternative aspect, the pre-filter may include a spectral filter.

In one aspect, the computed parameters may be adjusted based on a constraint. The constraint may be selectively applied only at desired times.

Other advantages may become apparent from the following detailed description when taken in conjunction with the drawings.

BRIEF DESCRIPTION OF THE DRAWINGS

The present invention is illustrated by way of example and not limited in the accompanying figures in which like reference numerals indicate similar elements and in which.

DETAILED DESCRIPTION

Figure 1:
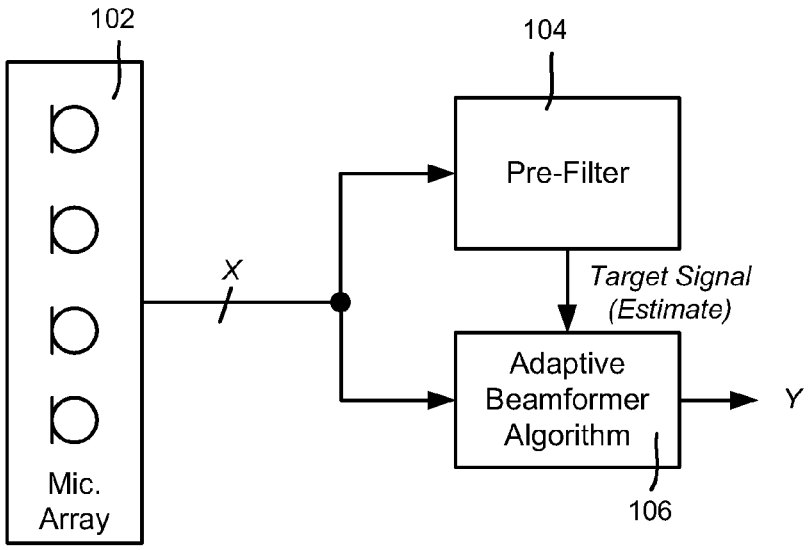
FIG. 1 is a block diagram showing example components for using an adaptive beamformer to process signals from an array of microphones.

Various aspects of the technology described herein are generally directed towards a sound processing system that achieves both significant noise reduction and improved perceptual quality. In general, the approach works by reversing the order of the two processing blocks. First, as represented in FIG. 1, a pre-filter that performs significant noise reduction is used to generate an output signal with low noise, but a potentially distorted signal. Rather than output this signal directly, the signal is used as the "target signal" estimate of an adaptive linear beamformer. Because the beamformer uses slowly evolving linear processing, there are minimal artifacts in the signal.

Further, performing the processing in this manner benefits from a new objective function for the array. This objective function, called Log Minimum Mean Squared Error, results in significant noise reductions and significant improvements in perceptual quality over other techniques.

Thus, as represented in FIG. 1, given the input (separate signals) from a microphone array 102, a pre-filter 104 is used to generate a target signal for an adaptive filtering (beamformer) algorithm 106. In various implementations, the pre-filter may be one that uses spatial information and/or uses spectral information. The adaptive beamformer algorithm 106 uses the target signal to dynamically (i.e., online) adapt its parameters to output a signal that has significant noise reduction and improved perceptual qualities.

Figure 2:
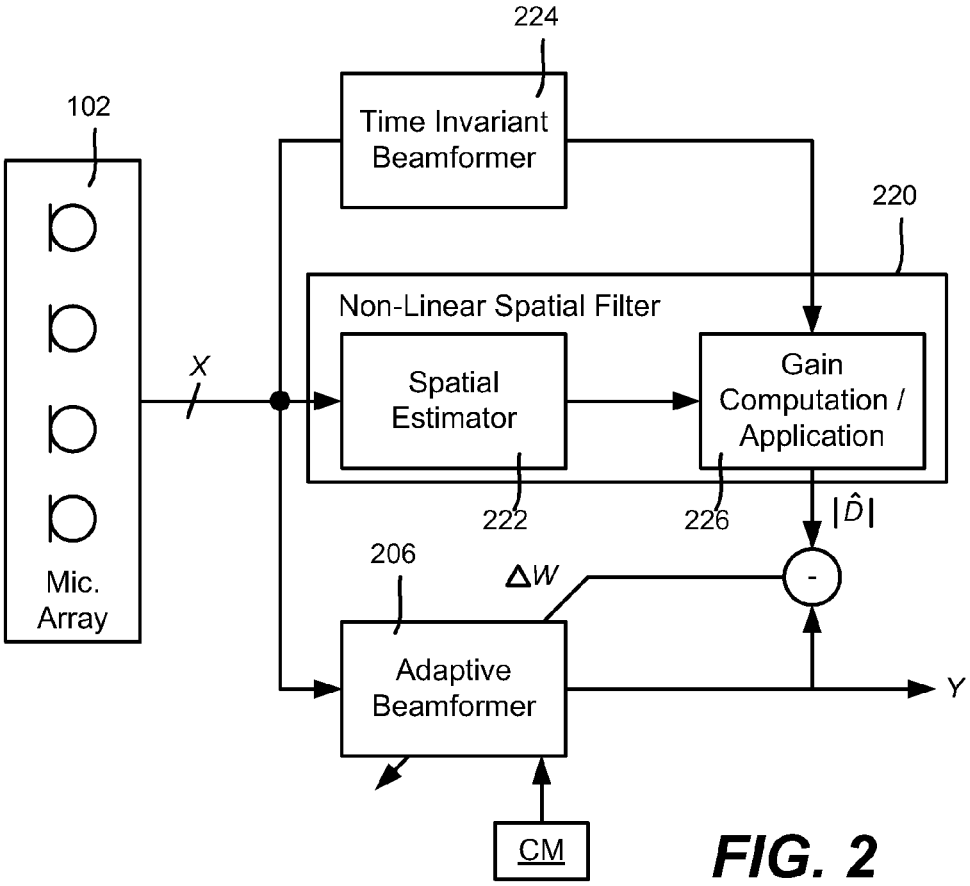
FIG. 2 is a block diagram showing example components for using an adaptive beamformer, a time invariant beamformer and a non-linear spatial filter to process signals from an array of microphones.

By way of example of more particular components, for frames of signals to process, FIG. 2 uses spatial information in the pre-filter, that is, a non-linear spatial filter 220. More particularly, for each frame a spatial estimator 222 or the like outputs a probability of a signal direction for each of a set of frequencies. The non-linear spatial filter 220 uses this data and the output of a time invariant (that is, one whose weights do not change over time) beamformer 224 (and possibly other dynamics data) to compute and apply a gain value, as represented by the gain computation/application block 226.

Instead of using this signal as the output, it is further processed and sent to an adaptive beamformer 206. More particularly, the phase may be discarded and the magnitude kept. The adaptive beamformer uses this magnitude estimate, which is a function of time, to dynamically compute parameters for varying the input signals from the microphones.

To this end, an error function may be minimized, e.g., $error_t=(|D_t|-|Y_t|)^2$, that is, the adaptive beamformer 206 may use a magnitude-domain objective function, e.g., magnitude-minimum mean squared error (Mag-MMSE).

Alternatively, the adaptive beamformer 206 may use a Log-domain (Log-MMSE) objective function: $error_t=(\log|D_t|-\log|Y_t|)^2$, or $errort_t^2=(\log|D_t|^2-\log|Y_t|^2)^2$. This takes advantage of the knowledge that a log operation is similar to the compression that occurs in the human auditory system and as a result, log-domain optimization is believed to be more perceptually relevant than spectral optimization. Secondly, because of the compressive nature of the log operation at large values, large differences in magnitude produce relatively small differences in the log domain. As a result, the log domain optimization is robust to errors in the estimation of the target signal's magnitude.

Also shown in FIG. 2 is a constraint mechanism CM that allows performing this signal processing with different constraints on the adaptive beamformer 206. In general and as described below, the adaptive beamformer 206 may operate with no constraints, full constraints, or partial constraints, comprising a constraint that is only operated occasionally (e.g. only during pauses).

Turning to beamformer technology in general, assume that a source signal $D_t(\omega)$ is captured by the array 102 of M microphones. The received signals $X_t(\omega)=\{X_{1,t}(\omega), \ldots, X_{M,t}(\omega)\}$ are then segmented into a sequence of overlapping frames, converted to the frequency domain using a short-time Fourier transform (STFT) and processed by a set of beamformer parameters $W_t(\omega)=\{W_{1,t}(\omega), \ldots, W_{M,t}(\omega)\}$ to create an output signal $Y_t(\omega)$ as follows:

$$Y_t(\omega) = \sum_m W^*_{m,t}(\omega)X_{m,t}(\omega) = W_t^H(\omega)X_t(\omega) \tag{1}$$

If a time-invariant beamformer is being employed, the weights do not vary over time, i.e., $W_t(\omega)=W(\omega)$. Note that as described herein, the various frequency bins may be processed independently, and as such are not referred to (frequency bin $\omega$) for simplicity.

In an adaptive beamformer the beamformer parameters (e.g., weights) $W_t$ are learned in an online manner, as samples are received. Most adaptive beamformers examine the derivation of time-invariant beamformers and substitute instantaneous estimates for long-term statistics. For example, the well-known Frost beamformer (based upon a Minimum Variance Distortionless Response or MVDR technology) minimizes the power of the array's output signal, subject to a linear constraint that specifies zero distortion in gain or phase from the desired look direction. This results in the following objective function:

$$H(W) = \frac{1}{2}W^H S_{XX} W + \lambda(W^H C - \mathcal{F}) \tag{2}$$

where C describes the steering vector in the desired look direction $\theta$ and F defines the desired frequency response in this direction. To derive an online adaptive version of an MVDR beamformer, one known solution used a gradient descent method whereby the weights at a given time instant are a function of the previous weights and the gradient of the objective function with respect to these weights.

$$W_{t+1}=W_t-\mu\nabla_W H(W_t) \tag{3}$$

These updated weights need to satisfy the distortionless constraint, such that $$W_{t+1}{}^H C=F \tag{4}$$

By taking the derivative of H(W), substituting (3) into (4), and solving for $W_{t+1}$, it can be shown that the adaptive beamformer has the following update equation:

$$W_{t+1}=P(W_t-\mu Y_t^H X_t)+F \tag{5}$$

where $\mu$ is the learning rate, $P=(I-C(C^HC)^{-1}C^H)$ and $F=C(CHC)C(C^HC)^{-1}F$ Nonlinear spatial filtering is conventionally used as a post-filtering algorithm to achieve further noise reduction of the output channel of a time-invariant beamformer. To this end, in a given frame and frequency bin, an Instantaneous DOA (IDOA) vector $\Delta_t$ is formed from the phase differences between the microphone signals in non-repetitive pairs. The spatial filter is formed by computing a probability that an observed $\Delta_t$ originated from the desired look direction $\theta$. This is done by first computing the Euclidean distance between $\Delta_t$ and $\Delta_\theta$, which is the IDOA vector generated by an ideal source originating from $\theta$. This distance in IDOA space is then converted to a distance in physical space, denoted $\Gamma_t^\theta$. For a linear array, this physical distance represents the absolute difference in radians between the angle of arrival of $X_t$ and the desired look direction $\theta$.

In the absence of noise, the distance $\Gamma_t^\theta$ is equal to zero if $\Delta_t=\Delta_\theta$. To reflect the presence of noise, it is assumed that $\Gamma_t^\theta$ follows a Gaussian distribution with zero mean and variance $\sigma_\theta^2$, i.e., $p(\Gamma_t^\theta)\sim N(0, \sigma_\theta^2)$. Estimates of the variance $\sigma_\theta^2$ are made online during non-speech segments for a discrete set of look directions.

The nonlinear spatial filter $\Lambda_t^\theta$ is computed as the ratio of the probabilities of $\Gamma_t^\theta$t and $\Gamma_{max}{}^\theta$, defined as the distance that generates the highest probability for the given look direction. This can be written as:

$$\Lambda_t^\theta = \frac{p(\Gamma_t^\theta)}{p(\Gamma_{max}^\theta)} \tag{6}$$

Note that $\Lambda_t^\theta$ is a real-valued function between 0 and 1. Thus, the filter, applied to the array output signal, controls the gain only. Because the phase is not compensated, this time-varying filter shares the same properties as other gain-based noise suppression algorithms, e.g., it can significantly increase the output SNR, but also cause significant distortion and artifacts.

In one implementation, the adaptive beamformer described herein is a log-MMSE adaptive beamformer. The adaptive beamformer described herein assumes no prior knowledge of the desired source signal $D_t$. However, as represented in FIG. 2, the above-described spatial filter generates an estimate of the magnitude of the desired source signal $|\hat{D}|$, which is used by the adaptive beamformer.

In one implementation, the beamformer may comprise a minimum mean squared error beamformer in the log domain. Note that operating in the log domain rather than in the magnitude or power spectral domains has advantages related to perceptual relevance and robustness to errors in estimated spectral magnitudes. A suitable error function is thus mean squared error of the log spectra of the desired signal and the array output:

$$W = \underset{W}{\operatorname{argmin}} E\left[(\log(|D|^2) - \log(|Y|^2))^2\right] \tag{7}$$

Since online adaptation is performed, the expectation with the instantaneous error is:

$$\epsilon_t = \frac{1}{2}(\log(|D_t|^2) - \log(|Y_t|^2))^2 \tag{8}$$

Taking the derivative of (8) with respect to the filter parameters gives:

$$\frac{\partial\epsilon}{\partial W} = -\frac{(\log(|D_t|^2) - \log(|Y_t|^2))}{|Y_t|^2} X_t X_t^H W_t \tag{9}$$

$$= -(\log(|D_t|^2) - \log(|Y_t|^2))\frac{X_t}{Y_t} \tag{10}$$

To avoid changing the weights too abruptly between frames, a frame's weights may be smoothed with a prior frame's weights, with a value $\mu$ (which may be fixed or dynamically adjustable) used as a balancing factor, that is, using (9), the gradient descent update rule can be written as:

$$W_{t+1} = W_t - \mu[\log(|Y_t|^2) - \log(|D_t|^2)]\frac{X_t}{Y_t} \tag{11}$$

The update equation (11) defines an unconstrained adaptive beamformer. If there are reliable estimates of the desired signal, this may be sufficient. However, if the desired signal approaches zero, an unconstrained adaptive beamformer may approach the degenerate solution $W_t=0$. Therefore, it may be desirable to impose a constraint on the adaptation.

To this end, there is described linearly constrained Log-MMSE beamforming. Consider that the adaptive beamformer is operating with a desired look direction that specifies C and a desired array response in that direction that specifies F. Thus, in this case, the objective function becomes:

$$\epsilon_t = \frac{1}{2}(\log(|D_t|^2) - \log(|Y_t|^2))^2 + \lambda(W^H C - \mathcal{F}) \tag{12}$$

Taking the gradient of (12) produces the following gradient expression:

$$\nabla_W \epsilon_t = -(\log(|D_t|^2) - \log(|Y_t|^2))\frac{X_t}{Y_t} + \lambda C \tag{13}$$

This produces the following constrained update expression:

$$W_{t+1} = W_t - \mu\left[(\log(|Y_t|^2) - \log(|D_t|^2))\frac{X_t}{Y_t} + \lambda C\right] \tag{14}$$

which needs to satisfy the linear constraint:

$$C^H W_{t+1} = F \tag{15}$$

where a real-valued function for is assumed for F so that $C^H W = W^H C$. The value of $\lambda$ can be found by substituting (14) into (15). Then, by substituting this value back into (14) and rearranging terms, the update expression is:

$$W_{t+1} = P\left[W_t - \mu(\log(|Y_t|^2) - \log(|D_t|^2))\frac{X_t}{Y_t}\right] + F \tag{10}$$

where P and F are defined above.

During processing, there may be times that is may be desirable to have the constraint active or inactive. For example, in long periods of silence, running the beamformer in a constrained mode is advantageous to prevent the filter weights from degenerating to the zero solution, while during periods of desired signal activity, it is desirable to have the beamformer best match the estimated log spectrum of the desired signal, irrespective of any constraints. Equations (11) and (16) show that these two modes of operation can be combined into a single update equation given by:

$$W_{t+1} = \tilde{P}\left[W_t - \mu(\log(|Y_t|^2) - \log(|D_t|^2))\frac{X_t}{Y_t}\right] + \tilde{F} \tag{17}$$

where $$\tilde{P} = \begin{cases} I - C(C^H C)^{-1} C^H, & \text{if } VAD = 0 \\ I, & \text{if } VAD = 1 \end{cases} \tag{18}$$

and $$\tilde{F} = \begin{cases} C(C^H C)^{-1}\mathcal{F}, & \text{if } VAD = 0 \\ 0, & \text{if } VAD = 1 \end{cases} \tag{19}$$

Turning to another aspect, because the system operates on log spectral values, finding an optimal value of $W_t$ requires a nonlinear iterative optimization method. However, because of the nonlinearity between the log spectral observations and the linear beamformer weights, the objective function is no longer quadratic. As a result, methods for improving the convergence of LMS algorithms, e.g. Normalized LMS (NLMS), cannot be applied. In order to improve convergence, a known nonlinear NLMS algorithm is used, in which the step size is normalized by the norm of the gradient of the output signal, $\log(|Y|^2)$, with respect to the parameters being optimized, W. This results in the following normalized step size expression:

$$\mu = \frac{\tilde{\mu}}{\left(\frac{\partial \log(|Y_t|^2)}{\partial W_t}\right)^H \left(\frac{\partial \log(|Y_t|^2)}{\partial W_t}\right)} = \frac{\tilde{\mu}}{\frac{X^H X}{|Y|^2}} \tag{20}$$

where $0<\tilde{\mu}<1$.

Exemplary Operating Environment

Figure 3:
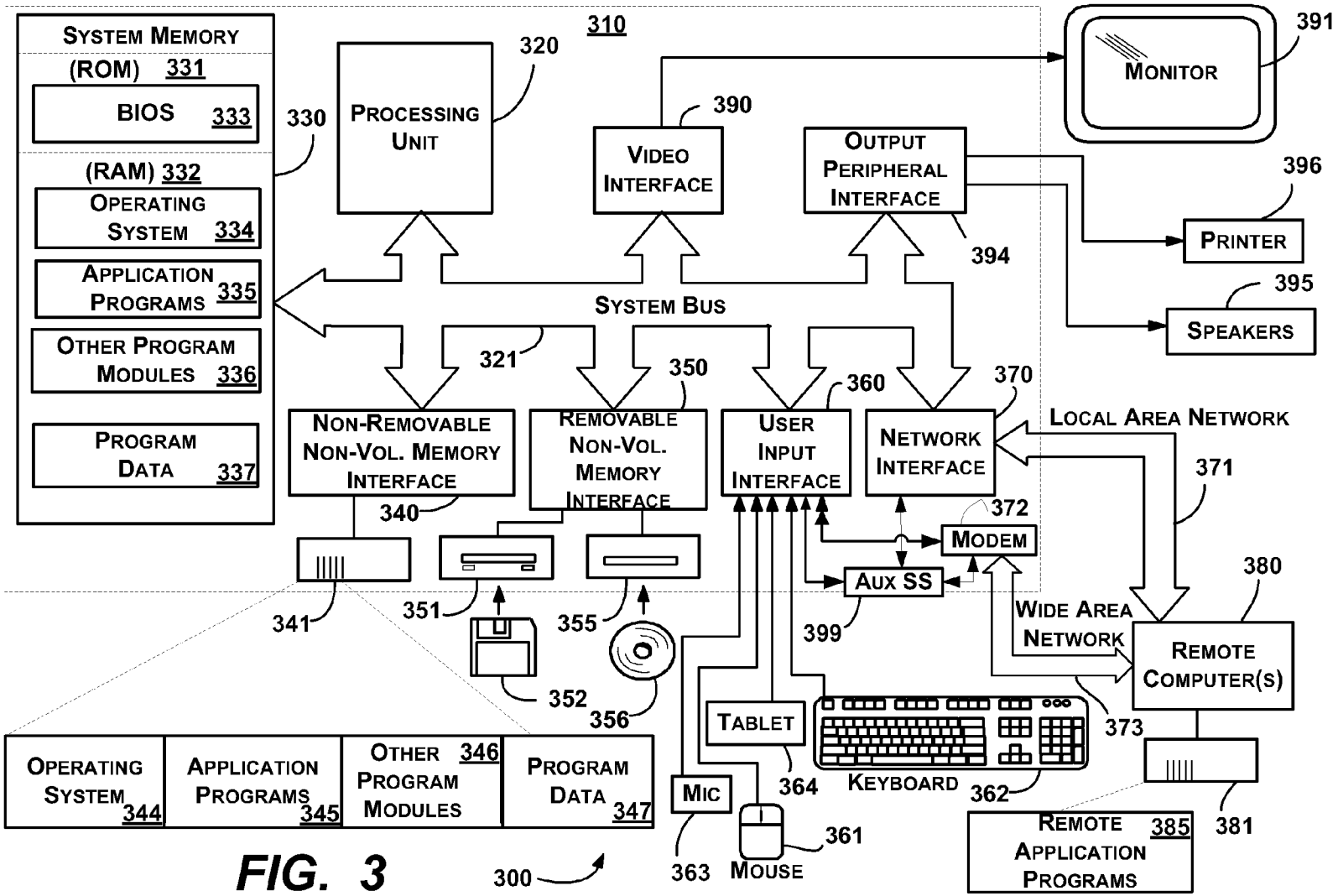
FIG. 3 shows an illustrative example of a computing environment into which various aspects of the present invention may be incorporated.

FIG. 3 illustrates an example of a suitable computing and networking environment 300 on which the examples of FIGS. 1-2 may be implemented. The computing system environment 300 is only one example of a suitable computing environment and is not intended to suggest any limitation as to the scope of use or functionality of the invention. Neither should the computing environment 300 be interpreted as having any dependency or requirement relating to any one or combination of components illustrated in the exemplary operating environment 300.

The invention is operational with numerous other general purpose or special purpose computing system environments or configurations. Examples of well known computing systems, environments, and/or configurations that may be suitable for use with the invention include, but are not limited to: personal computers, server computers, hand-held or laptop devices, tablet devices, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer. Generally, program modules include routines, programs, objects, components, data structures, and so forth, which perform particular tasks or implement particular abstract data types. The invention may also be practiced in distributed computing environments where tasks are performed by remote processing devices that are linked through a communications network. In a distributed computing environment, program modules may be located in local and/or remote computer storage media including memory storage devices.

With reference to FIG. 3, an exemplary system for implementing various aspects of the invention may include a general purpose computing device in the form of a computer 310. Components of the computer 310 may include, but are not limited to, a processing unit 320, a system memory 330, and a system bus 321 that couples various system components including the system memory to the processing unit 320. The system bus 321 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

The computer 310 typically includes a variety of computer-readable media. Computer-readable media can be any available media that can be accessed by the computer 310 and includes both volatile and nonvolatile media, and removable and non-removable media. By way of example, and not limitation, computer-readable media may comprise computer storage media and communication media. Computer storage media includes volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can accessed by the computer 310. Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above may also be included within the scope of computer-readable media.

The system memory 330 includes computer storage media in the form of volatile and/or nonvolatile memory such as read only memory (ROM) 331 and random access memory (RAM) 332. A basic input/output system 333 (BIOS), containing the basic routines that help to transfer information between elements within computer 310, such as during start-up, is typically stored in ROM 331. RAM 332 typically contains data and/or program modules that are immediately accessible to and/or presently being operated on by processing unit 320. By way of example, and not limitation, FIG. 3 illustrates operating system 334, application programs 335, other program modules 336 and program data 337.

The computer 310 may also include other removable/non-removable, volatile/nonvolatile computer storage media. By way of example only, FIG. 3 illustrates a hard disk drive 341 that reads from or writes to non-removable, nonvolatile magnetic media, a magnetic disk drive 351 that reads from or writes to a removable, nonvolatile magnetic disk 352, and an optical disk drive 355 that reads from or writes to a removable, nonvolatile optical disk 356 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 341 is typically connected to the system bus 321 through a non-removable memory interface such as interface 340, and magnetic disk drive 351 and optical disk drive 355 are typically connected to the system bus 321 by a removable memory interface, such as interface 350.

The drives and their associated computer storage media, described above and illustrated in FIG. 3, provide storage of computer-readable instructions, data structures, program modules and other data for the computer 310. In FIG. 3, for example, hard disk drive 341 is illustrated as storing operating system 344, application programs 345, other program modules 346 and program data 347. Note that these components can either be the same as or different from operating system 334, application programs 335, other program modules 336, and program data 337. Operating system 344, application programs 345, other program modules 346, and program data 347 are given different numbers herein to illustrate that, at a minimum, they are different copies. A user may enter commands and information into the computer 310 through input devices such as a tablet, or electronic digitizer, 364, a microphone 363, a keyboard 362 and pointing device 361, commonly referred to as mouse, trackball or touch pad. Other input devices not shown in FIG. 3 may include a joystick, game pad, satellite dish, scanner, or the like. These and other input devices are often connected to the processing unit 320 through a user input interface 360 that is coupled to the system bus, but may be connected by other interface and bus structures, such as a parallel port, game port or a universal serial bus (USB). A monitor 391 or other type of display device is also connected to the system bus 321 via an interface, such as a video interface 390. The monitor 391 may also be integrated with a touch-screen panel or the like. Note that the monitor and/or touch screen panel can be physically coupled to a housing in which the computing device 310 is incorporated, such as in a tablet-type personal computer. In addition, computers such as the computing device 310 may also include other peripheral output devices such as speakers 395 and printer 396, which may be connected through an output peripheral interface 394 or the like.

The computer 310 may operate in a networked environment using logical connections to one or more remote computers, such as a remote computer 380. The remote computer 380 may be a personal computer, a server, a router, a network PC, a peer device or other common network node, and typically includes many or all of the elements described above relative to the computer 310, although only a memory storage device 381 has been illustrated in FIG. 3. The logical connections depicted in FIG. 3 include one or more local area networks (LAN) 371 and one or more wide area networks (WAN) 373, but may also include other networks. Such networking environments are commonplace in offices, enterprise-wide computer networks, intranets and the Internet.

When used in a LAN networking environment, the computer 310 is connected to the LAN 371 through a network interface or adapter 370. When used in a WAN networking environment, the computer 310 typically includes a modem 372 or other means for establishing communications over the WAN 373, such as the Internet. The modem 372, which may be internal or external, may be connected to the system bus 321 via the user input interface 360 or other appropriate mechanism. A wireless networking component 374 such as comprising an interface and antenna may be coupled through a suitable device such as an access point or peer computer to a WAN or LAN. In a networked environment, program modules depicted relative to the computer 310, or portions thereof, may be stored in the remote memory storage device. By way of example, and not limitation, FIG. 3 illustrates remote application programs 385 as residing on memory device 381. It may be appreciated that the network connections shown are exemplary and other means of establishing a communications link between the computers may be used.

An auxiliary subsystem 399 (e.g., for auxiliary display of content) may be connected via the user interface 360 to allow data such as program content, system status and event notifications to be provided to the user, even if the main portions of the computer system are in a low power state. The auxiliary subsystem 399 may be connected to the modem 372 and/or network interface 370 to allow communication between these systems while the main processing unit 320 is in a low power state.

CONCLUSION

While the invention is susceptible to various modifications and alternative constructions, certain illustrated embodiments thereof are shown in the drawings and have been described above in detail. It should be understood, however, that there is no intention to limit the invention to the specific forms disclosed, but on the contrary, the intention is to cover all modifications, alternative constructions, and equivalents failing within the spirit and scope of the invention.

What is claimed is:

1. In a computing environment, a method comprising:

receiving input signals from a plurality of microphones at an adaptive beamformer and a time invariant beamformer, the adaptive beamformer including an adaptive beamformer algorithm;

receiving an output estimation from a non-linear spatial filter that is based on the input signals, wherein the non-linear spatial filter uses the input signals to compute a probability of a signal direction for each of the input signals, and wherein the non-linear spatial filter computes the output estimation using output from the time invariant beamformer and the probability computed;

computing parameters of the adaptive beamformer algorithm using the output estimation from the non-linear spatial filter and an output signal from the adaptive beamformer, wherein the output signal is used to compute weights for each of the plurality of microphones; and processing the input signals into the output signal using the parameters of the adaptive beamformer algorithm.

2. The method of claim 1 wherein the output estimation corresponds to a particular frequency bin, and further comprising, receiving at least one other estimation corresponding to at least one other frequency bin.

3. The method of claim 1 wherein using the output estimation to compute the parameters comprises using a magnitude corresponding to the output estimation in a magnitude-domain objective function.

4. The method of claim 1 wherein using the output estimation comprises to compute the parameters comprises using a log-based magnitude computation corresponding to the output estimation in a log magnitude-domain objective function.

5. The method of claim 1 further comprising, using the non-linear spatial filter comprises using spatial information in the non-linear spatial filter to determine the output estimation.

6. The method of claim 1 further comprising, using the non-linear spatial filter comprises using spectral information in the non-linear spatial filter to determine the output estimation.

7. The method of claim 1 further comprising using a constraint to further vary the input signals from the microphones into the output signal.

8. The method of claim 1 further comprising, using a partial constraint to occasionally further vary the input signals from the microphones into the output signal.

9. The method of claim 1 further comprising smoothing the parameters based upon parameters corresponding to at least one prior frame.

10. In a computing environment, a system comprising:

at least one processor;

a memory communicatively coupled to the at least one processor;

an output estimation mechanism implemented on the at least one processor and configured to receive input signals from a plurality of microphones and configured to generate an output estimation including magnitude information, wherein the input signals are used to compute a probability of a signal direction for each of the input signals, and wherein the output estimation mechanism generates the output estimation using output from a time invariant beamformer and the probability computed, wherein the time invariant beamformer generates the output using the input signals; and an adaptive beamformer having an adaptive beamformer algorithm, the adaptive beamformer configured to receive the output estimation and the input signals, the adaptive beamformer algorithm configured to combine the input signals using weights dependent on the output estimation to generate an output signal, wherein the weights are computed for each of the plurality of microphones using the output estimation, and wherein the output signal is based on the weights computed and the input signals.

11. The system of claim 10 wherein the adaptive beamformer computes the weights via a magnitude-domain objective function.

12. The system of claim 10 wherein the adaptive beamformer computes the weights via a log-magnitude-domain objective function.

13. The system of claim 10 wherein the adaptive beamformer computes the weights via a log-power-domain objective function.

14. The system of claim 10 wherein the estimation mechanism comprises a time invariant beamformer coupled to a non-linear spatial filter.

15. The system of claim 10 wherein the estimation mechanism includes a pre-filter that processes spectral information.

16. The system of claim 10 further comprising a constraint mechanism that when operative, constrains at least one of the weights.

17. One or more tangible computer-readable storage devices having computer-executable instructions stored thereon, which in response to execution by a computer, cause the computer to perform steps comprising:

receiving input signals from a plurality of microphones at a time invariant beamformer, a non-linear spatial filter, and an adaptive beamformer;

using the input signals to compute a probability of a signal direction for each of the input signals at the non-linear spatial filter;

receiving an output from the time invariant beamformer at the non-linear spatial filter;

using the output from the time invariant beamformer and the probability of the signal direction for each of the input signals to compute an output estimation at the non-linear spatial filter;

receiving the output estimation from the non-linear spatial filter at the adaptive beamformer;

using the output estimation and a combined signal from the adaptive beamformer to compute weights for each of the plurality of microphones; and outputting the combined signal from the adaptive beamformer that is based on the weights for each of the plurality of microphones and the input signals.

18. The one or more tangible computer-readable storage devices of claim 17 wherein using the output estimation received from the time invariant beamformer at the adaptive beamformer comprises using a log-based magnitude computation.

19. The one or more tangible computer-readable storage devices of claim 17 having further computer-executable instructions stored thereon, which in response to execution by the computer, cause the computer to perform steps further comprising, using a constraint to adjust the parameters.

20. The one or more tangible computer-readable storage devices of claim 19 having further computer-executable instructions stored thereon, which in response to execution by the computer, cause the computer to perform steps further comprising, selectively deciding when to use the constraint and when not to use the constraint.

* * * * *